US005344036A

United States Patent [19]

Stanescu et al.

[11] Patent Number: 5,344,036

[45] Date of Patent: Sep. 6, 1994

[54] CONTAINER SYSTEM

[75] Inventors: Liana V. Stanescu, Durham; Timothy J. Fischer, Raleigh; Kristin L. Leese, Cary; Kenneth J. Leonhardt, Rougemount, all of N.C.

[73] Assignee: Akzo N.V., Arnhem, Netherlands

[21] Appl. No.: 894,531

[22] Filed: Jun. 4, 1992

[51] Int. Cl.[5] ..... B65D 41/00

[52] U.S. Cl. ..... 215/251; 215/249; 215/254; 215/317; 215/355; 215/100 R; 215/1 C; 220/270; 220/737; 422/102

[58] Field of Search ..... 215/247, 248, 249, 253, 215/254, 305, 317, 321, 355, 100 R, 100.5, 1 C, DIG. 3, 364, 251; 220/266, 270, 729, 737, 740; 422/102

[56] References Cited

U.S. PATENT DOCUMENTS

| | | | |
|---|---|---|---|
| 3,888,377 | 6/1975 | Stadler | 215/249 |
| 4,226,334 | 10/1980 | Weiler et al. | 215/355 |
| 4,251,003 | 2/1981 | Bodenmann | 215/254 |
| 4,413,741 | 11/1983 | Curchack | 215/100 R |
| 4,919,284 | 4/1990 | Tiedemann et al. | 215/12.1 |
| 4,989,623 | 2/1991 | Hoffman . | |
| 5,002,392 | 3/1991 | Swope et al. . | |
| 5,040,894 | 8/1991 | Karp et al. . | |
| 5,066,336 | 11/1991 | Hoffman et al. . | |
| 5,068,181 | 11/1991 | Driscoll . | |
| 5,085,332 | 2/1992 | Gettig et al. | 215/249 |
| 5,205,423 | 4/1993 | Ota | 215/12.1 |

OTHER PUBLICATIONS

Burtis et al, "Design and Evaluation of an Anti-Evaporative Cover for Use with Liquid Containers," Clinical Chemistry, vol. 38, No. 5 (1992) pp. 768-775.

*Primary Examiner*—Allan N. Shoap
*Assistant Examiner*—Nova Stucker
*Attorney, Agent, or Firm*—Spencer, Frank & Schneider

[57] ABSTRACT

A container system for reagents and other substances used in a medical diagnostic apparatus. The container system includes a vial made of blow-molded plastic, which can withstand lyophilization. The bottom portion of the vial has an annular groove and is shaped as a truncated cone below the annular groove. An auxiliary member can be snap-connected to the vial at the annular groove so that the vial will stand upright on a flat surface and contains a central aperture through which the vial remains in contact with the flat surface. The container system also includes a stopper at the mouth of the vial and a snap-on plastic cover to secure the stopper. The cover has a tab which is kept at a raised position by a lifter protrusion which bears against the stopper. The cover has tearslots which are ripped when the tab is pulled. One of the tearslots is shorter than the other and keeps the tab from being entirely detached from the remainder of the cover when the tab is pulled.

17 Claims, 3 Drawing Sheets

FIG. 9
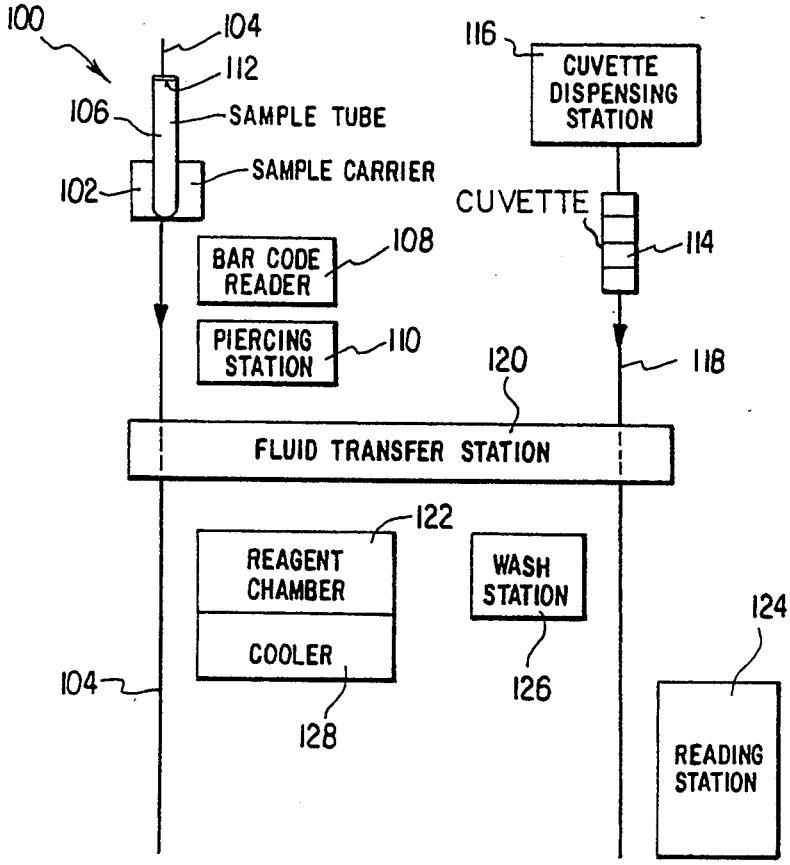
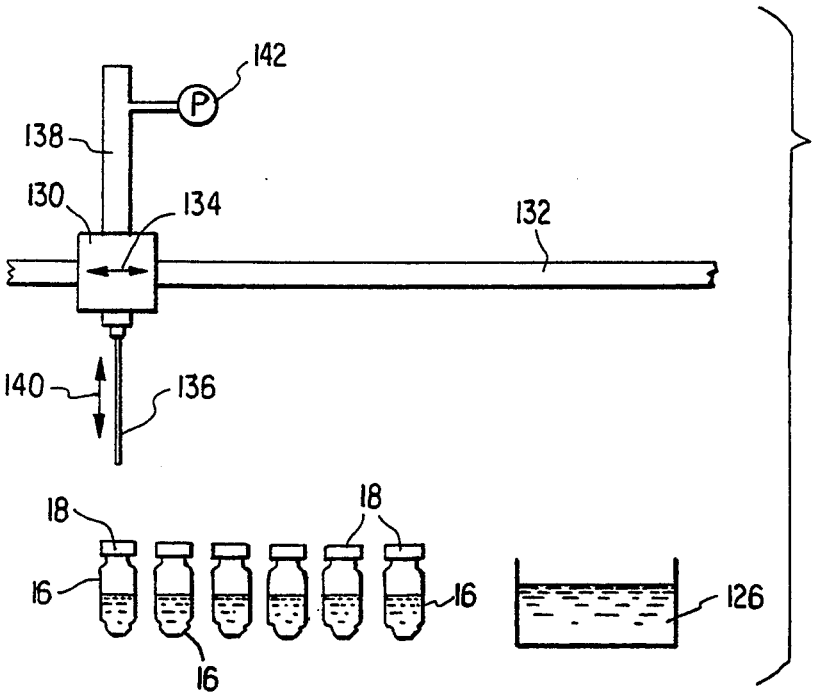
FIG. 10

CONTAINER SYSTEM

BACKGROUND OF THE INVENTION

The present invention is directed to a container system, and more particularly to a container system for liquid reagents used in performing assays on a medical diagnostic apparatus, wherein the liquid reagents can be lyophilized.

The analysis of plasma or other fluid from a patient can provide a physician with valuable information about the patient's medical condition. Typically, a blood sample is withdrawn from a patient into a vacuum sample tube, which is sent to a laboratory in order to perform specific diagnostic assays. The assays are performed by treating the sample with various reagents, buffer solutions, and control and calibration liquids. Automated diagnostic machines are commonly used to perform the assays in a highly reliable and automatic manner.

Reagents which contain biologically active materials such as proteins and enzymes are used in many assays. Often, these types of reagents must be very pure and have a specified potency. These requirements are difficult to fulfill since biologically active material can be easily damaged.

Certain reagents in liquid form deteriorate at an undesirably rapid rate and are lyophilized to improve long term stability. Alternatively, acceptable quality can be maintained if the reagents are frozen, but this poses obvious problems in distribution and storage of the reagents. Furthermore, frozen reagents would have to be thawed under controlled conditions before use in assays, and the time required of skilled technicians would increase costs. For these reasons it has become common in the art to prepare reagents in dried form by a procedure called "lyophilization." In this "freeze drying" procedure, water is extracted from a reagent that is cooled and exposed to vacuum. The extraction of the moisture leaves a dry powder of biologically active material which can have a room-temperature shelf life of years, depending on the reagent.

Conventionally, lyophilization of a reagent is done in a glass vial with a flat base that supports the vial in an upright position during the procedure. Glass has been the material of choice since it is a good heat conductor, a factor which facilitates the lyophilization process. It is also impervious to water. However, glass vials are fragile and can be relatively expensive to manufacture to stringent specifications. Glass can also denature certain proteins due to its surface charge characteristics.

It has been considered impractical to use plastic instead of glass as the vial. Until recently, plastics were not as impervious to moisture as needed for the lyophilization, nor were they able to sustain their molded shape when subjected to the conditions of heat and vacuum that occur during lyophilization.

Prior to use, the lyophilized reagent is reconstituted by adding a liquid, such as a buffer or water, to the vial. Because of the flat-bottomed shape, appreciable quantities of expensive reagents remain in the bottom of the vial when the vial is used on an automated machine.

A blow-molded plastic vial for medical substances has recently been introduced by Abbott Laboratories. It is believed that the plastic employed is incompatible with lyophilization of reagents in the vial. The vial is slightly over five centimeters tall and has an outer diameter of slightly over two centimeters. The vial has a top portion configured to accept a screw-on cap, a cylindrical intermediate portion, and an inwardly tapering bottom portion. The bottom portion includes a conical region which has a very obtuse apex angle (considerably more than 90°) and which rises from a cone tip to an annular bead. The annular bead of the bottom portion is followed upwardly by an annular groove disposed just below the cylindrical intermediate portion of the vial. A plastic auxiliary member, which includes a disc-shaped portion connected to one end of a cylindrical portion, is configured to snap onto the bottom portion of the vial to provide the vial with a flat bottom surface. Once attached, the auxiliary member cannot be pried off without difficulty. The cone tip of the vial is spaced apart from the disc-shaped portion of the auxiliary member by an air gap when the auxiliary member is snapped onto the vial. Such an air gap has an insulating quality that retards heat transfer through the bottom portion of the vial. The disc-shaped portion of the auxiliary member has a small breather hole that is disposed at an eccentric position, near the cylindrical portion of the auxiliary member. This breather hole is the sole aperture in the disc-shaped portion.

Glass vials are generally sealed with stoppers that are secured by crimped metal covers. One type of cover can be removed by pulling a metal tab off of the top. As sharp edges are then exposed, it is possible that the personnel dealing with these types of covers can be cut and exposed to toxic chemicals in the laboratory.

SUMMARY OF THE INVENTION

An object of the invention is to provide a container system which alleviates the above-noted drawbacks of conventional container systems for dry or liquid reagents.

Another object of the invention is to provide a container system which includes a blow-molded vial whose interior tapers toward the bottom in order to promote efficient utilization of reconstituted reagent.

Another object of the invention is to provide a container system which includes a blow-molded plastic vial with a tapered bottom portion and an auxiliary member which can be used at the bottom of the vial to hold the vial upright or at the top of the vial to retard evaporation through the mouth of the vial.

Another object of the invention is to provide a container system which includes a vial, a stopper for the mouth of the vial, and a tear-away plastic cover for securing the stopper, the cover having a tab which is held at a raised position for easy accessibility.

These and other objects which will become apparent from the ensuing detailed description can be attained by providing a container system which includes a blow-molded plastic vial having a bottom portion with an inwardly tapering region, and a plastic auxiliary member which has a flat portion with the center cut out, and which is configured to be snap-connected to the bottom portion of the vial so that the vial can be supported on a flat surface in an upright position by the auxiliary member. The bottom portion of the vial comes into contact with the heat exchange portion of the lyophilizer through the cut out region of the auxiliary member.

BRIEF DESCRIPTION OF THE DRAWINGS

FIG. 9 is a diagram schematically illustrating an example of a medical diagnostic apparatus with which the container system of the present invention may be used; and FIG. 10 is a front elevational view schematically showing how the fluid transfer station of FIG. 9 cooperates with a row of container systems in the reagent chamber.

DESCRIPTION OF THE PREFERRED EMBODIMENT

Figure 1:
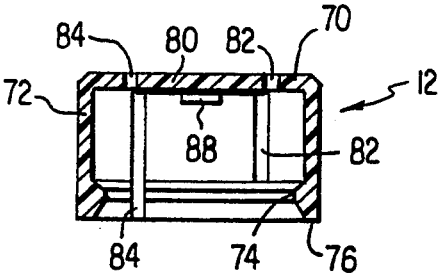
FIG. 1 is a cross-sectional view of a cover which forms part of the container system of the present invention.
Figure 2:
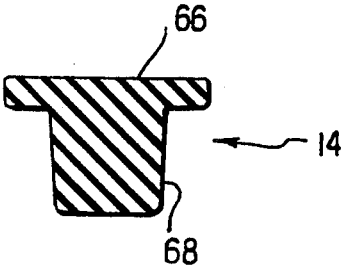
FIG. 2 is a cross-sectional view of a stopper which forms part of the container system.
Figure 3:
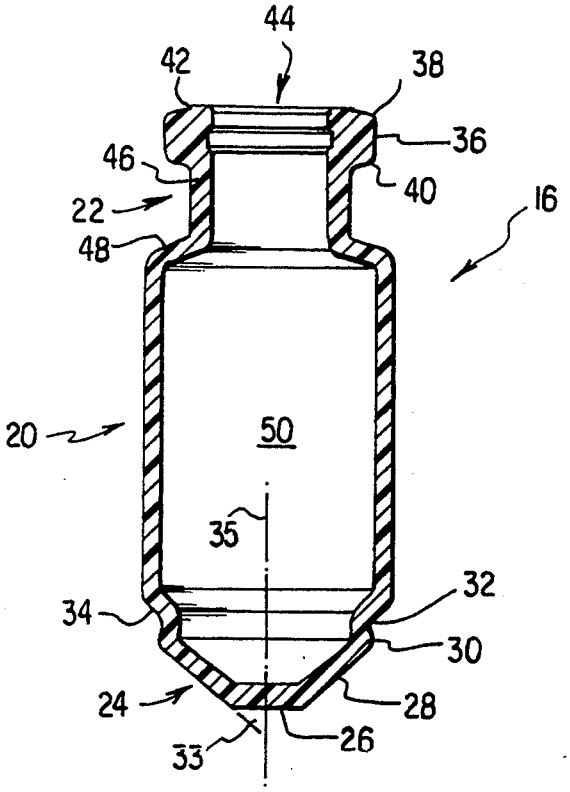
FIG. 3 is a cross-sectional view of a vial which forms part of the container system.
Figure 4:
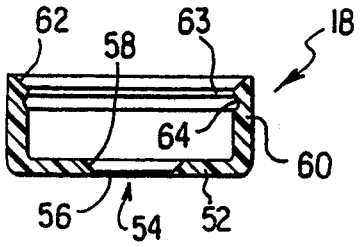
FIG. 4 is a cross-sectional view of an auxiliary member which forms part of the container system.

The container system of the present invention includes a cover 12 as shown in FIG. 1, a stopper 14 as shown in FIG. 2, a vial 16 as shown in FIG. 3, and an auxiliary member 18 as shown in FIG. 4. Stopper 14, vial 16, and auxiliary member 18 are radially symmetrical.

Referring to FIG. 3, vial 16 includes a cylindrical intermediate portion 20 between a top portion 22 and an inwardly tapering bottom portion 24. The bottom portion 24 includes a flat lower surface 26 and a sloping lateral surface 28 which extends upward to an annular bead 30. Bottom portion 24 also includes an annular groove 32 immediately above annular bead 30. Between groove 32 and the lower end of cylindrical intermediate portion 20, bottom portion 24 has a small outwardly flaring region 34. It will be apparent that bottom portion 24 is configured as a truncated cone in the region from lower surface 26 to annular bead 30. Surface 28 is disposed at a slope angle 33 with respect to the axis 35 of vial 16.

Top portion 22 of vial 16 includes an annular lip 36 having an upper shoulder 38 and a lower shoulder 40. Above annular lip 36 is a short cylindrical region 42 at which the mouth 44 of vial 16 opens. Below lip 36, top portion 22 has a cylindrical neck 46 and an outwardly flaring region 48 which connects neck 46 to the upper end of cylindrical intermediate portion 20.

Vial 16 is preferably translucent and is blow-molded from a polypropylene which provides a high degree of moisture protection for the material (not shown in FIG. 3) to be stored in vial 16. Such a polypropylene is available under the trademark, "DYPRO-7231X", from Fina Oil and Chemical Company, Cosden Chemical Division, 8350 North Central Expressway, Post Office Box 410, Dallas, Tex. 75221. For example, one preferred set of dimensions is: The height of vial 16, from lower surface 26 to the top of region 42, is approximately 37 mm. The outer diameter of intermediate central portion 20 is approximately 15 mm. The inner diameter of mouth 44 is approximately 7 mm. The wall thickness of vial 16 is generally uniform except at lip 36, which is substantially thicker than the wall thickness elsewhere. The total capacity of the interior 50 of vial 16, if it is filled completely to the top, is approximately 3.5 ml. However, any size container following this design is considered to be part of this invention. The preferred dimensions are only preferred and not the sole dimensions usable in the invention.

Turning next to FIG. 4, auxiliary member 18 includes a disc-shaped portion 52 having a central aperture 54. Aperture 54 has a short cylindrical segment 56 followed by a segment 58 configured as a truncated cone. The surface of segment 58 has the same slope angle as the lateral surface 28 of the bottom portion 24 of vial 16 (i.e., slope angle 33). The inner diameter of cylindrical segment 56 is approximately 5 mm, which is less than the inner diameter of mouth 44 of vial 16. Auxiliary member 18 can be made of a colored material, which would be useful for identification purposes.

Auxiliary member 18 also includes a cylindrical portion 60, one end of which is integrally connected to disc-shaped portion 52. The other end terminates at a sloping surface 62, which has the same slope angle as lateral surface 28 (i.e., slope angle 33). The inner wall of portion 60 is provided with an annular groove 64 near sloping surface 62, leaving an annular nose 63 between surface 62 and groove 64.

Auxiliary member 18 is preferably injection-molded from translucent polypropylene. Other useful materials are polyethylene, terephthalate, high density polyethylene, and low density polyethylene.

Referring next to FIG. 2, stopper 14 includes a disc-shaped portion 66 and a tapered stem 68. Stopper 14 is made of rubber, such as opaque butyl rubber, and may be colored, which aids in identifying the material stored in the vial. Stopper 14 is available under stock number "PT-13" from Tompkins Rubber Company, 550 Township Line Road, Blue Bell, Pa. 19422.

Figure 5:
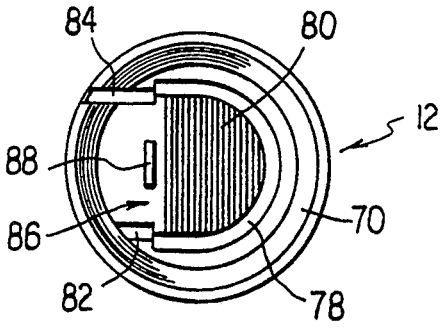
FIG. 5 is a bottom plan view of the cover.
Figure 6:
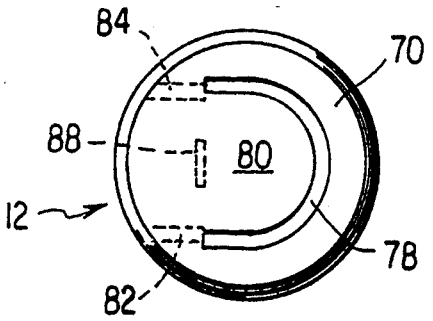
FIG. 6 is a top plan view of the cover.

With reference next to FIG. 1 (a cross-sectional view of cover 12), FIG. 5 (a bottom plan view), and FIG. 6 (a top plan view), cover 12 includes a disc-shaped top 70 and a cylindrical portion 72 connected to top 70. An annular protrusion 74 is provided inside portion 72 at a position spaced slightly apart from the bottom edge 76 of portion 72.

Top 70 of cover 12 has a C-shaped slot 78 within which is a tab 80. Inside cover 12, a tearslot 82 extends from one end of C-slot 78 to the top of annular protrusion 74. A tearslot 84 extends from the other end of C-shaped slot 78 through protrusion 74 to bottom end 76. Tearslots 82 and 84 are provided by deep grooves in the plastic from which cover 12 is made, so that the plastic at the bottom of the grooves is thin enough to be easily ripped.

The underside of tab 80 has ribs 86. Furthermore, an elongated lifter protrusion 88 is provided on the underside of top 70 about midway between the ends of C-shaped slot 78.

Cover 12 is a translucent member which is preferably injection-molded from low density polyethylene, or any plastic that can be molded to produce a thin, tear-away groove.

The container system of the present invention is particularly useful with reagents for an automated medical diagnostic machine. A liquid reagent can be lyophilized in a vial 20 and then stored for generally up to three years prior to use, depending on the product lyophilized. At the time of use the lyophilized reagent is reconstituted by adding a liquid, such as sucrose, buffer or water to the vial, which is then placed in the automated machine.

Assume, for purposes of illustration, that Verify® (Organon Teknika Corporation, Durham, N.C., U.S.A.) Reference Plasma is the reagent of interest. An auxiliary member 18 is first snapped onto the bottom portion 24 of a vial 16 bearing an appropriate label (not illustrated). Being made of plastic, auxiliary member 18 is resilient. As the member 18 is pressed against the bottom portion 24, its sloping surface 62 slides against the lateral surface 28 of bottom portion 24 and expands cylindrical portion 60 of the member 18. When member 18 has been fully inserted, bead 30 of vial 20 lodges in groove 64 and nose 63 of member 18 extends into groove 32 to retain member 18 on vial 20. Coupled together in this way, the disc-shaped portion 52 of member 18 provides vial 20 with a flat-bottomed surface so that it can be placed on a flat surface with its mouth 44 extending upward. The lower end of vial 20, in the region adjacent lower surface 26, extends into the aperture 54 of member 18, and surface 26 is flush with the lower surface portion 52.

Vial 20 is then filled to a designated level with reference plasma and a stopper 14 is loosely inserted in mouth 44. The stopper 14 can be color-coded to identify reference plasma as one of the reagents that may be contained in vial 20. The vial 20, with the member 18 and stopper 14, is then placed between a pair of horizontal plates (not illustrated) in a vacuum chamber (not illustrated). Auxiliary member 18 and lower surface 26 of vial 16 rest on the lower plate, which is cooled. Heat is extracted from the reference plasma primarily by conduction through surface 26. The water in the reference plasma sublimates and increases the pressure within vial 20 as compared to the rest of the vacuum chamber, so vapor escapes through passageways attributable to the loose placement of stopper 14 in mouth 44. When all of the moisture escapes a powdery plasma residue 90 (see FIG. 7) is left in the bottom of vial 20. The plates in the chamber are then moved together to force stopper 14 downward. A stoppered vial of vacuum-packed plasma residue can then be removed from the vacuum chamber.

Figure 7:
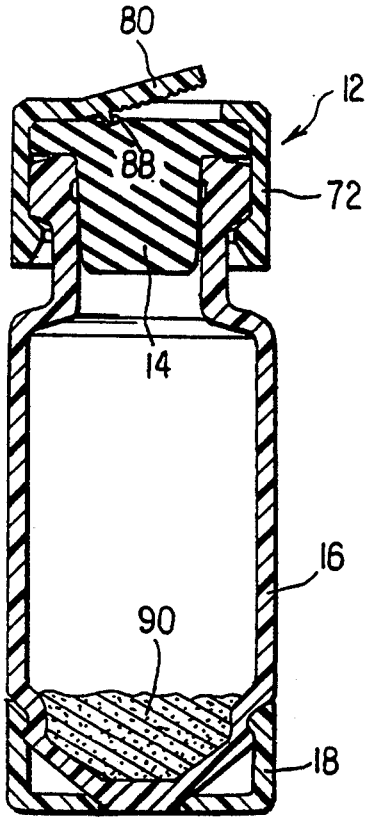
FIG. 7 is a sectional view of the complete container system, with dried reagent inside the vial.

After the vial of dried reference plasma has been removed from the vacuum chamber, a cap 12 is applied to ensure that stopper 14 does not accidentally become dislodged. This is accomplished by forcing the cap 12 downward over the stopper 14 until its annular protrusion 74 lodges beneath the lower shoulder 40 of the vial's lip 36. As this occurs, the lifter means, a protrusion 88 of cap 12, engages the stopper 14 to pivot tab 80 to a raised position as shown in FIG. 7. Since cover 12 is translucent the color of stopper 14 or auxiliary member 18 remains visible. The container system with its lyophilized reagent is then sealed in a foil pouch for redundant moisture protection.

Reference plasma is only one of the reagents that may be lyophilized in the above manner. Other examples of reagents include streptokinase, thrombin, chromogenic substrate, $\alpha$-thrombin III, and phospholipids. Buffers, as well as calibration and control fluids that are used in a medical diagnostic machine may also be stored in the container systems of the present invention. It is expected that liquids that are traditionally lyophilized in glass vials can be lyophilizable in the system. However, since the buffers are inorganic solutions they need not be lyophilized and can, instead, be stored in liquid form.

To use a container of dried reagent, a technician opens the foil pouch (not illustrated) and, while gripping the vial 16 with one hand, pulls the tab 80 with the other hand. The ribs 86 on the underside of tab 80 assure a firm grip. Pulling tab 80 rips the thin plastic at tearstrips 82 and 84. Tearstrip 82 rips only down to protrusion 74, but a slight twisting motion on the tab thereafter rips tearstrip 84 all the way down to bottom edge 76 so that the technician is able to remove cap 12 during a single pulling step. The technician then pries stopper 14 out. The short cylindrical region 42 ensures a slight gap between the underside of disc-shaped portion 66 of the stopper and lip 36 of vial 16. This slight gap facilitates removal of stopper 14.

Figure 8:
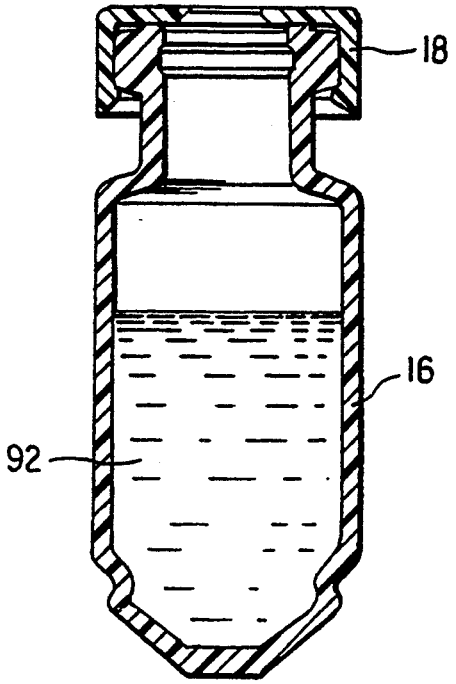
FIG. 8 is a sectional view of the vial and auxiliary member when in use to hold reconstituted reagent.

After removal of stopper 14, the vial 16 can be placed on a table (auxiliary member 18 still being attached to bottom portion 24) and reagent reconstituted by filling vial 16 to a predetermined depth with distilled water. After thorough mixing, the auxiliary member 18 is snapped off from the bottom portion 24 of vial 16, inverted, and placed on the top portion 22 as shown in FIG. 8. The vial of reconstituted reference plasma 92 can now be placed in an automated diagnostic machine for use in medical testing procedures. When other container systems of dried reagents have been prepared in the same way, they are also placed in the machine. As was noted above, containers of buffer solutions which have been liquid all along and thus do not need to be regenerated are typically also used during diagnostic procedures.

The fluids in the container systems of the present invention may be used with a medical diagnostic apparatus 100 as shown schematically in FIG. 9. Apparatus 100 includes a sample carrier 102 which is moved along a sample track 104. A number of sample tubes 106 (only one of which is shown) are transported by carrier 102. Each sample tube 106 contains a specimen (blood, for example) that is to be analyzed by the apparatus 100. Furthermore each tube 106 bears a label (not illustrated) with a bar code that identifies the patient and the analytic procedures that are to be performed on the specimen by apparatus 100.

Carrier 102 transports the sample tubes 106 past a bar code reader 108, which reads the labels. Thereafter, the sample tubes 106 move past a piercing station 110 which pierces the seal 112 closing each sample tube. Meanwhile, cuvettes 114 from a cuvette dispensing station 116 are conveyed along a cuvette path 118. Each cuvette 114 has four reaction wells.

The medical diagnostic apparatus 100 also includes a fluid transfer station 120. When a sample tube 106 reaches station 120, some of the fluid is transferred to the appropriate wells (as determined by the information read by bar code reader 108) of a cuvette 114. Additionally, buffers and reconstituted reagents and control and calibration solutions from vials 16 which have been loaded into a reagent chamber 122 are transferred to appropriate wells of the cuvette 114, again in accordance with the information read by bar code reader 108. Cuvette 114 then moves along path 118 past a reading station 124, where the contents of the reaction wells are examined optically to provide the information designated by the bar code read by reader 108. A printer (not illustrated) then prints out the results of the test in a standard format.

Apparatus 100 also includes a wash station 126 for cleaning pipettes (not illustrated in FIG. 9) of fluid transfer station 120 after each fluid transfer. A cooler 128 keeps the reagents in chamber 122 at 6° C.

A medical diagnostic apparatus device which includes the features described above with respect to FIG. 9 is commercially available from Organon Teknika Corporation, Durham, N.C. (USA) under the designation "Multichannel Discrete Analyzer." Further information about cuvette 114 and cuvette dispensing station 116 is available in U.S. Pat. No. 5,040,894. Further information about reading station 124 is available in U.S. Pat. Nos. 5,002,392 and 5,068,181. Further information about fluid transfer station 120 is available in U.S. Pat. Nos. 4,989,623 and 5,066,336. These patents are incorporated herein by reference. Further information about cuvette path 118 and apparatus 100 as a whole is available in application, Ser. No. 07/833,950, filed Feb. 11th, 1992. This application is also incorporated herein by reference.

Chamber 122 has positions for four rows of vials 16. Three of these rows accommodate seven vials and the fourth row accommodates six. One of these rows is illustrated schematically in FIG. 10, along with a portion of fluid transfer station 120 that cooperates with this row.

The illustrated portion of transfer station 120 includes a carrier 130 which is supported on a rail 132, only a portion of which is shown. Carrier 130 is moved by a motor (not shown) in the directions indicated by arrow 134. A pipette 136 and an elongated chamber 138 are mounted on the carrier 130. Pipette 136 is movable into or out of chamber 138 by a motor (not illustrated) as indicated by arrow 140. During operation, carrier 130 is positioned above a desired vial 16 and the pipette 136 is lowered through the central aperture 54 in its auxiliary member 18. A pump 142 is then actuated to aspirate a predetermined volume of reagent (typically 0.01 ml) into pipette 136, which is then raised. Carrier 130 is then moved above a cuvette 114 and the reagent is expelled into the appropriate reaction well. Thereafter, carrier 130 is moved to a position above wash station 126, whereupon the pipette 136 is lowered and washed in preparation for another cycle of reagent delivery.

It was previously noted that, in the preferred embodiment of the container system of the present invention, mouth 44 of vial 16 has an inner diameter of 7 mm and that cylindrical segment 56 of the aperture 54 in auxiliary member 18 has a diameter of 5 mm. Such a diameter permits passage of pipette 136 while effectively reducing the area of the opening in the vial by almost 50%. This expedient reduces evaporation and thus helps to maintain the reagent in the vial 16 at a constant concentration as it is used. Moreover, the fact that the interior 50 of vial 16 tapers inward at the bottom promotes economy since pipette 136 can reliably withdraw a greater portion of the reagent than would be prudent if the inner diameter of the vial did not narrow at its bottom. That is, the bottom of the interior of vial 16 is shaped so as to concentrate the last milliliter of reconstituted reagent in a central pool so that more of it can be removed without the risk of drawing bubbles into pipette 136. Although not shown, cooler 128 has recesses with surfaces which conform to the conical surfaces 28 of the vials 16 in order to facilitate heat transfer so that the reagents can be maintained at approximately 6° C. during operation of apparatus 100.

It will be understood that the above description of the present invention is susceptible to various modifications, changes, and adaptations, and the same are intended to be comprehended within the meaning and range of equivalents of the appended claims.

What is claimed is:

1. A container system, comprising:

a blow-molded plastic vial having a bottom portion with an inwardly tapering region which is configured as a truncated cone with a flat bottom, the vial additionally having an annular groove adjacent the bottom portion; and a plastic auxiliary member having a flat portion with a central aperture and having means connected to the flat portion for snap-connecting the auxiliary member to the bottom portion of the vial so that the vial can be supported on a flat surface in an upright position by the auxiliary member, the means for snap-connecting engaging the annular groove, wherein part of the bottom portion of the vial extends into the central aperture of the flat portion of the auxiliary member when the auxiliary member is snap-connected to the bottom portion.

2. The container system of claim 1, in combination with material in the vial, wherein the vial remains intact after the material in the vial has undergone lyophilization.

3. The container system of claim 1, wherein the inwardly tapering region of the bottom portion of the vial has a predetermined slope angle, and wherein the aperture in the flat portion of the auxiliary member has a surface configured as a truncated cone having a slope angle that is substantially the same as the slope angle of the inwardly tapering region of the bottom portion of the vial.

4. The container system of claim 1, wherein the vial additionally has an upper portion with a mouth and a lip adjacent the mouth, the mouth being larger than the aperture in the flat portion of the auxiliary member, wherein the means for snap-connecting the auxiliary member to the bottom portion of the vial comprises a tubular wall extending from one side of the flat portion, and wherein the tubular wall has cross-sectional dimensions that are larger than the cross-sectional dimensions of the lip so that the auxiliary member can be detached from the bottom portion of the vial and inserted on the top portion, with the tubular wall surrounding the lip.

5. The container system of claim 1, wherein the flat portion of the auxiliary member is generally disk-shaped and has a periphery, and wherein the means for snap-connecting the auxiliary member to the bottom portion of the vial comprises a cylindrical portion having an inner end and an outer end, the inner end of the cylindrical portion being integrally connected to the flat portion adjacent the periphery thereof.

6. The container system of claim 5, wherein the inwardly tapering region of the bottom portion of the vial has a predetermined slope angle, and wherein the outer end of the cylindrical portion has a sloping surface with a slope angle that is substantially the same as the slope angle of the inwardly tapering region of the bottom portion of the vial.

7. A container system, comprising:

a blow-molded plastic vial having a top portion with a mouth and an annular lip surrounding the mouth;

a stopper for the mouth of the vial; and a plastic cover for securing the stopper, the cover including a top portion having a tab and a tubular portion which extends downward from the top portion, the tubular portion of the cover having an inner protrusion which grips the lip, wherein the tab is surrounded by a generally C-shaped slot having a first slot end and a second slot end, wherein the tubular portion of the cover has a bottom edge, and wherein the cover has a first groove defining a first tearslot which extends from the first end of the slot to the bottom edge of the tubular portion and a second groove defining a second tearslot extending from the second end of the slot to the inner protrusion on the tubular portion.

8. A container system, comprising:

a blow-molded plastic vial having a bottom portion with an inwardly tapering region which is configured as a truncated cone having a predetermined slope angle; and a plastic auxiliary member which includes a flat portion with a central aperture, the aperture having a surface configured as a truncated cone with a slope angle that is substantially the same as the slope angle of the inwardly tapering region of the bottom portion of the vial, the auxiliary member additionally including means connected to the flat portion for snap-connecting the auxiliary member to the bottom portion of the vial so that the vial can be supported on a flat surface in an upright position by the auxiliary member, the means for snap-connecting including a cylindrical portion having an outer end, the outer end of the cylindrical portion having a sloping surface with a slope angle which is substantially the same as the slope angle of the inwardly tapering region of the bottom portion of the vial, wherein part of the bottom portion of the vial extends into the central aperture of the flat portion of the auxiliary member when the auxiliary member is snap-connected to the bottom portion.

9. The container system of claim 8, wherein the vial additionally has an upper portion with a mouth and an annular lip which surrounds the mouth, the mouth of the vial being larger than the aperture in the flat portion of the auxiliary member, and wherein the cylindrical portion of the auxiliary member has an inner diameter that is greater than the outer diameter of the lip so that the auxiliary member can be detached from the bottom portion of the vial and inserted on the top portion of the vial, with the cylindrical portion surrounding the lip.

10. A container system, comprising:

a blow-molded plastic vial having an upper portion with a mouth and a lip adjacent the mouth and having a bottom portion with an inwardly tapering region;

a plastic auxiliary member having a flat portion with a central aperture which is smaller than the mouth of the vial and having means connected to the flat portion for snap-connecting the auxiliary member to the bottom portion of the vial so that the vial can be supported on a flat surface in an upright position by the auxiliary member, the means for snap-connecting including a tubular wall extending from one side of the flat portion;

a stopper for the mouth of the vial; and a plastic cover for securing the stopper, the cover including a top portion having a tab and a tubular portion which extends downward from the top portion, the tubular portion of the cover having an inner protrusion which grips the lip, wherein part of the bottom portion of the vial extends into the central aperture of the flat portion of the auxiliary member when the auxiliary member is snap-connected to the bottom portion, and wherein the tubular wall has cross-sectional dimensions that are larger than the cross-sectional dimensions of the lip so that the auxiliary member can be detached from the bottom portion of the vial and inserted on the top portion, with the tubular wall surrounding the lip.

11. The container system of claim 10, wherein the tab is surrounded by a generally C-shaped slot having a first slot end and a second slot end, wherein the tubular portion of the cover has a bottom edge, and wherein the cover has a first groove defining a first tearslot which extends from the first end of the slot to the bottom edge of the tubular portion and a second groove defining a second tearslot extending from the second end of the slot to the inner protrusion on the tubular portion.

12. The container system of claim 10, wherein the top portion of the cover has a bottom side which faces the stopper, and wherein the cover further comprises means on the bottom side of the top portion for keeping the tab at an elevated position.

13. The container system of claim 12, wherein the means for keeping the tab at an elevated position comprises a lifter protrusion on the bottom side of the top portion of the cover, the lifter protrusion bearing against the stopper.

14. The container system of claim 12, wherein the tab has a roughened bottom side.

15. A container system, comprising:

a blow-molded plastic vial having a top portion with a mouth and an annular lip surrounding the mouth;

a stopper for the mouth of the vial; and a plastic cover for securing the stopper, the cover including a top portion with a bottom side which faces the stopper, the top portion of the cover having a tab with a roughened bottom side, the cover additionally including means on the bottom side of the top portion of the cover for keeping the tab at an elevated position, and a tubular portion which extends downward from the top portion, the tubular portion of the cover having an inner protrusion which grips the lip.

16. A container system, comprising:

a blow-molded plastic vial having a bottom portion with an inwardly tapering region;

a plastic auxiliary member having a disk-shaped portion with a central aperture;

means, having a first portion provided by the vial and a second portion provided by the auxiliary member, for snap-connecting the auxiliary member to the bottom portion of the vial so that the vial can be supported on a flat supporting surface in an upright position by the auxiliary member, wherein part of the bottom portion of the vial extends into the central aperture of the disk-shaped portion of the auxiliary member when the auxiliary member is snap-connected to the bottom portion, and wherein the disk-shaped portion of the auxiliary member has a bottom surface and the inwardly tapering region of the vial has a bottom surface that is substantially coplaner with the bottom surface of the disk-shaped portion when the auxiliary member is snap-connected to the vial.

17. A container system comprising:

a blow-molded plastic vial having a bottom portion with an inwardly tapering region;

a plastic auxiliary member having a disk-shaped portion with a central aperture;

means, having a first portion provided by the vial and a second portion provided by the auxiliary member for snap-connecting the auxiliary member to the bottom portion of the vial so that the vial can be supported on a flat supporting surface in an upright position by the auxiliary member, wherein part of the bottom portion of the vial extends into the central aperture of the disk-shaped portion of the auxiliary member when the auxiliary member is snap-connected to the bottom portion, and wherein the inwardly tapering portion of the vial has a bottom surface that rests upon the supporting surface when the auxiliary member is snap-connected to the auxiliary member and supported on the supporting surface by the auxiliary member.

* * * * *